US007461695B2

(12) United States Patent
Boney et al.

(10) Patent No.: US 7,461,695 B2
(45) Date of Patent: Dec. 9, 2008

(54) SYSTEM AND METHOD FOR CREATING PACKERS IN A WELLBORE

(75) Inventors: Curtis L. Boney, Houston, TX (US); Lawrence J. Leising, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 267 days.

(21) Appl. No.: 11/216,230

(22) Filed: Aug. 31, 2005

(65) Prior Publication Data

US 2006/0219406 A1 Oct. 5, 2006

Related U.S. Application Data

(60) Provisional application No. 60/667,599, filed on Apr. 1, 2005.

(51) Int. Cl.
*E21B 43/04* (2006.01)

(52) U.S. Cl. ..... 166/278; 166/51

(58) Field of Classification Search ..... 166/278, 166/285, 387, 51
See application file for complete search history.

(56) References Cited

U.S. PATENT DOCUMENTS 3,866,681 A 2/1975 Shirley
4,944,348 A * 7/1990 Whiteley et al. ..... 166/278
5,577,559 A * 11/1996 Voll et al. ..... 166/278
5,588,487 A * 12/1996 Bryant ..... 166/51
5,765,642 A 6/1998 Surjaatmadja ..... 166/297
6,394,184 B2 5/2002 Tolman et al. ..... 166/281
6,464,006 B2 * 10/2002 Womble ..... 166/276
6,486,828 B1 11/2002 Cahn et al. ..... 342/363
6,494,256 B1 12/2002 Achee, Jr. et al. ..... 166/51
6,520,255 B2 2/2003 Tolman et al. ..... 166/281
6,575,243 B2 6/2003 Pabst ..... 166/250.08
6,575,251 B2 6/2003 Watson et al. ..... 166/387
6,619,397 B2 9/2003 Coon et al. ..... 166/278
6,814,144 B2 11/2004 Jones ..... 166/281
6,857,475 B2 * 2/2005 Johnson ..... 166/278
2002/0117301 A1 * 8/2002 Womble ..... 166/278
2002/0148610 A1 * 10/2002 Bussear et al. ..... 166/278
2004/0050551 A1 * 3/2004 Jones ..... 166/308.5
2004/0094299 A1 5/2004 Jones
2005/0082060 A1 * 4/2005 Ward et al. ..... 166/278
2007/0044966 A1 * 3/2007 Davies et al. ..... 166/287

FOREIGN PATENT DOCUMENTS

WO WO2005/059304 6/2005

* cited by examiner

*Primary Examiner*—Shane Bomar
(74) *Attorney, Agent, or Firm*—Michael Flynn; David Cate; Robin Nava

(57) ABSTRACT

A system and method is provided for creating a packer in a wellbore for utilization in a variety of wellbore applications. The packer is created by flowing a slurry of particular matter and liquid to a desired location. At the desired location, the slurry is dehydrated, leaving deposition of the particulate matter to create a packer.

48 Claims, 5 Drawing Sheets

SYSTEM AND METHOD FOR CREATING PACKERS IN A WELLBORE

CROSS REFERENCE TO RELATED APPLICATION

This application claims priority from U.S. Provisional Application 60/667,599 filed Apr. 1, 2005, which is incorporated herein by reference.

BACKGROUND

In numerous wellbore environments, a variety of wellbore assemblies are used for well related activities. For example, a bottom hole assembly can be used in many types of well related procedures, including well stimulation, cementing, water control treatments or other procedures. In many of these well applications, a packer is used to isolate a region of the wellbore in which the desired activity is conducted.

In some applications, cup type downhole packers have been utilized, and in other applications, mechanical or hydraulic packers have been employed. Cup type downhole packers have an elastomeric sealing element designed to seal against a casing wall. However, the elastomeric sealing element is subject to wear due to this contact with the casing wall and/or contact with burrs along the inside of the casing left from the creation of perforations. Cup type packers also are prone to getting stuck, and they present additional problems in horizontal wells due to the natural positioning of the bottom hole assembly on a low side of the hole, leaving uneven clearance on the low side relative to the high side of the hole. Mechanical and hydraulic packers also are subject to wear and damage due to burrs left from casing perforation. Additionally, such packers are more complicated, expensive and prone to failure in a sand laden environment, while offering poor performance in open hole applications. Attempts have been made to form a packer from sand at a desired location in the wellbore, but current methods do not work well in many applications.

SUMMARY

In general, the present invention provides a system and method of creating one or more packers at a desired location or locations within a wellbore for use in specific wellbore applications. A slurry of liquid and particulate matter is flowed downhole and to a dehydration device. At this location, the particulate matter is released from the liquid and deposited while the liquid is routed to another location. The continual dehydration of the slurry and consequent deposition of particulate matter creates a packer at the desired location within the wellbore. Once the packer is established, a variety of wellbore treatments or other applications can be conducted in the well.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to wellbore applications in which a packer is generated in situ. This is accomplished by dehydration of a slurry formed of a mixture of liquid and particulate matter. The liquid is separated from the particulate matter such that the particulate matter is deposited to generate the packer at the desired location or locations within the wellbore. The slurry dehydration can be accomplished by a variety of techniques, including taking a return flow of the liquid through the wellbore assembly tubing, e.g. coiled tubing, drill pipe or jointed tubing. The dehydration also may be created by a properly positioned choke, by creating a tight annular clearance, by a cup style packer, by combinations of these mechanisms or by other appropriate mechanisms, as described more fully below.

Prior to, during or after creation of the packer, additional aspects of the wellbore application can be conducted. For example, perforation procedures, formation stimulation techniques, acidizing, cementing applications, or water control treatments can be accomplished. Subsequently, the packer can be cleared by eliminating the condition causing dehydration of the slurry, by backwashing the packer, by dissolving the packer with acid, by pulling, jarring, or vibrating the equipment adjacent the built packer, or by a combination of the aforementioned clearing methods.

The ability to generate the packer enables adaptation of the packer to casing size and condition variations as well as to open hole applications or applications within external screens or other tubular components. Also, the packer is self-healing in the sense that the packer continues to build as long as particular matter, such as sand, is carried to the desired area. Multiple packers can be generated with a single trip into the wellbore thus saving costs and often simplifying the procedure. For example: a BHA initially can be moved to a desired location in wellbore; a packer is then built; a well related procedure is carried out; the BHA is then moved to another location; another packer is built; a subsequent well related procedure is carried out; and this process is repeated as many times as desired during the single trip into the wellbore.

Figure 1:
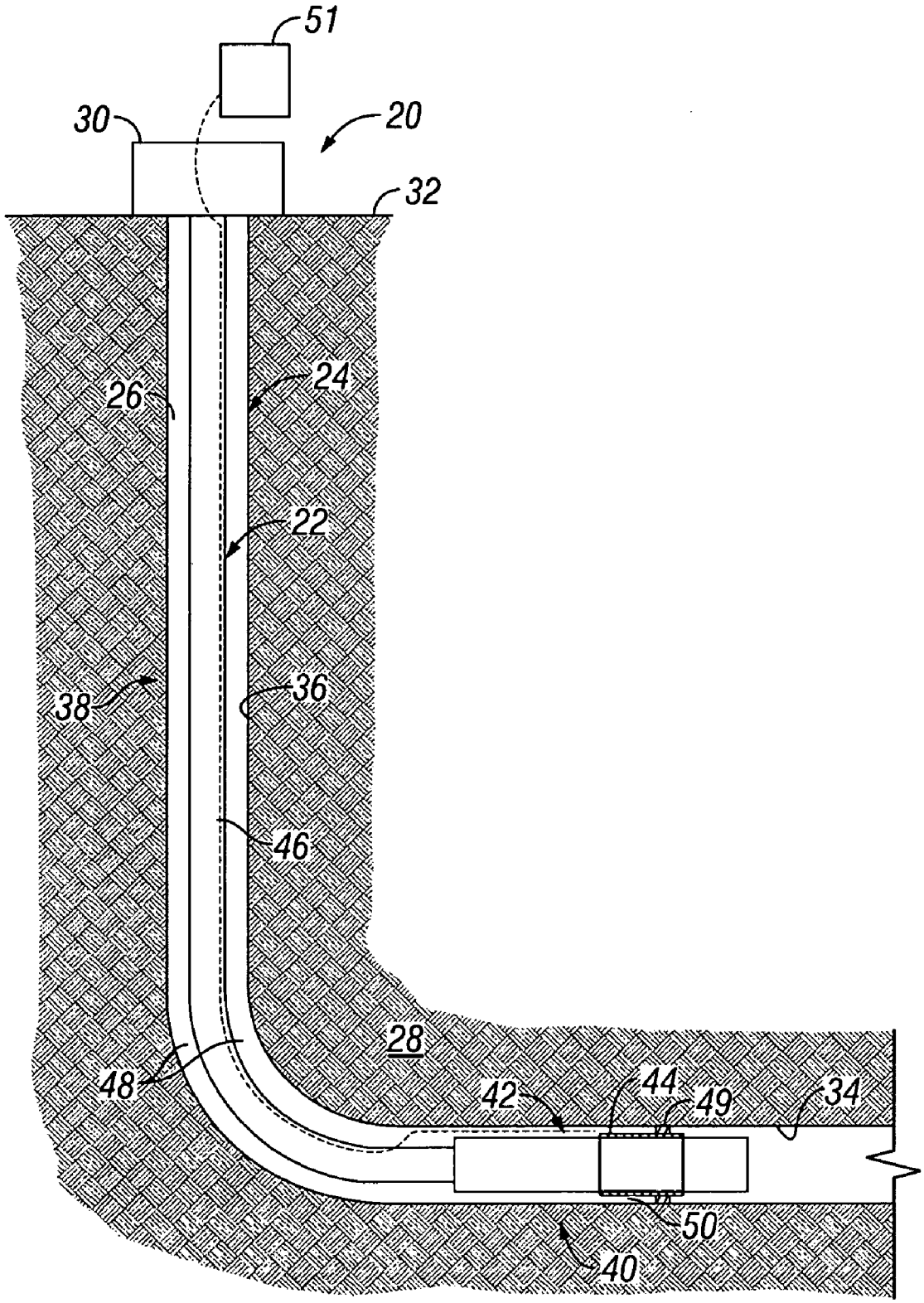
FIG. 1 is a front elevation view of a wellbore assembly disposed in a wellbore, according to an embodiment of the present invention.

Referring generally to FIG. 1, a system 20 is illustrated according to an embodiment of the present invention. In the particular embodiment illustrated, system 20 comprises a wellbore assembly 22 disposed in a well 24 formed by a wellbore 26 drilled into a formation 28. Formation 28 may hold desirable production fluids, such as oil. Wellbore assembly 22 extends downwardly into wellbore 26 from a wellhead 30 that may be positioned along a surface 32, such as the surface of the earth or a seabed floor. The wellbore 26 may comprise open hole sections, e.g. open hole section 34, cased sections lined by a casing 36, or a combination of cased sections and open hole sections. Additionally, wellbore 26 may be formed as a vertical wellbore or a deviated, e.g. horizontal, wellbore. In the embodiment illustrated in FIG. 1, wellbore 26 comprises a vertical section 38 and a deviated section 40 which is illustrated as generally horizontal. Packers can be generated in either or both vertical sections and deviated sections of wellbore 26.

In the example illustrated, wellbore assembly 22 comprises an operational assembly 42, such as a bottom hole assembly, having a dehydration device 44. Wellbore assembly 22 supports the dehydration device 44 on a tubing 46, such as coiled tubing, drill pipe or jointed tubing. The wellbore assembly 22 creates a surrounding annulus 48 that extends, for example, along the exterior of at least tubing 46 and often along at least a portion of operational assembly 42 to dehydration device 44. The dehydration device 44 may comprise a variety of mechanisms or combinations of mechanisms 49. Examples of mechanisms 49 include chokes, screens, cup style packers, annular orifices, sealing elements, a tighter clearance 50 between the dehydration device and a surrounding wall, and other mechanisms able to direct the slurry flow such that liquid is separated from the particulate matter. For example, the dehydration device can be used to create a pressure drop that encourages liquid flow through a screen sized to block particular matter in the slurry.

Well related parameters can be tracked by a control system 51, such as a computer-based control system. Control system 51 can be used to collect data, such as temperature and pressure data, in real-time. The data is collected from the well to provide an indication or roadmap as to the progress of various procedures. For example, control system 51 can be used to monitor the creation and elimination of packers at multiple levels within the wellbore.

It should be noted that use of the terminology down, downward, downwardly or up, upward or upwardly reflects relative positions along wellbore 26. Regardless of whether the wellbore is vertical or horizontal, down, downward or downwardly mean further into the wellbore relative to wellhead 30, and up, upward or upwardly mean a position along the wellbore that is closer to the wellhead 30 relative to a given reference point.

Figure 2:
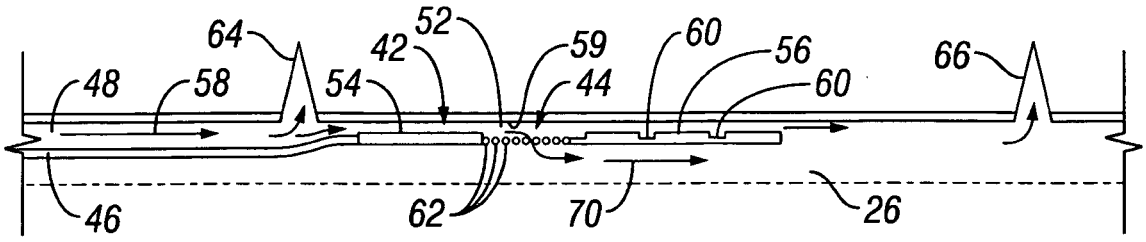
FIG. 2 is a schematic illustration of an embodiment of a portion of the wellbore assembly deployed at a desired location in the wellbore, according to an embodiment of the present invention.

In the embodiment illustrated in FIG. 2, dehydration device 44 comprises a screen 52 positioned between a pack seal area 54 and a choke 56. Effectively, dehydration device 44 comprises screen 52 and choke 56 which cooperate to separate a slurry 58. The slurry, indicated by arrow 58, is formed of liquid and particulate matter that is flowed downwardly through annulus 48 along tubing 46 and pack seal area 54. The annulus 48 is defined at its exterior by a wall 59 that may be formed by the formation in an open hole section, by casing 36, by an outlying screen section, such as a gravel pack screen, or by another surface radially spaced from and surrounding at least a portion of operational assembly 42.

As the slurry 58 flows along screen 52, the liquid portion moves through screen 52 causing the consequent deposition of particulate matter. Some of the slurry also may flow past screen 52, but choke 56 is designed to create a pressure drop that encourages flow through screen 52 rather than flow down the annulus surrounding choke 56. A plurality of annular rings 60 can be formed in choke 56 to further encourage passage of the liquid through screen 52. In this embodiment, screen 52 comprises openings 62 that allow the liquid to pass through while preventing the particulate matter, e.g. sand, from entering the inside of the screen. In this application, dehydration device 44 is positioned between an upper perforation 64 and a lower perforation 66.

Figure 3:
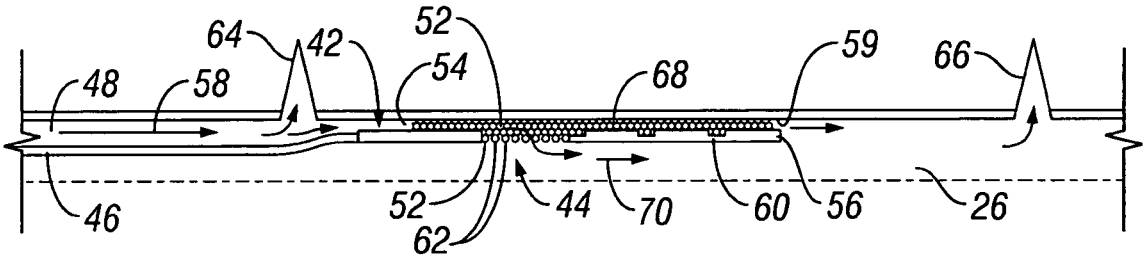
FIG. 3 is a schematic illustration of the embodiment illustrated in FIG. 2 with a packer formed, according to an embodiment of the present invention.

Once dehydration device 44 is positioned at a desired location within wellbore 26, slurry 58 is flowed downwardly through annulus 48 and a packer 68 begins to build over choke 56, as illustrated in FIG. 3. The packer 68 then continues to expand upward to cover screen 52 and then pack seal area 54. When dehydration device 44 is located in a horizontal or other type of deviated wellbore, packer 68 continues to build as long as the flow velocity over pack seal area 54 is sufficient to carry sand to the top of the packer. In this embodiment, slurry 58 is delivered to the desired area along a first flow path, and the separated liquid is directed along a second flow path which is routed downwardly through assembly 42, as indicated by arrows 70. As the packer builds, liquid flow through the packer is reduced. Packer 68 is readily built in several types of locations, including in an annulus defined on its exterior by an open hole section, a cased section or a screen section, e.g. a gravel pack screen.

Before, during and/or after generation of packer 68, other aspects of the wellbore application can be completed. For example, perforation procedures (normally done before generation of packer 68), formation stimulation techniques, cementing applications, or water control treatments can be implemented. When the application at that wellbore location is completed, packer 68 can be eliminated, and assembly 42 can be withdrawn from the wellbore or moved to another location in the wellbore for creation of another packer 68. The ability to generate and eliminate packers enables multi-layer applications within a wellbore without removal of wellbore assembly 22.

Thus, various well related procedures can be carried out in different zones between or during the sequential building of packers along the wellbore. For example, packer 68 can be formed at one location to enable treatment of the well interval. The packer is then unset, and assembly 42 is moved to the next desired wellbore location, e.g. an adjacent zone. At that location, another packer 68 is formed and a well treatment is carried out. Packer 68 can be repeatedly formed and unset at multiple locations, e.g. levels, within the well.

According to one method, assembly 42 is moved downhole to a desired perforation location. A perforation tool is then used to form perforations, followed by the building of packer 68 below the perforations. Subsequently, a fracturing procedure or other procedure is performed. Once the procedure is completed, assembly 42 is moved to another wellbore location, e.g. a location upward from the previously formed perforations, and the perforation tool is used again to form perforations in another zone. Another packer 68 is built below the perforations, and a procedure such as fracturing is carried out.

This process can be repeated at multiple zones. It should be noted that in some applications, packer 68 is washed or flushed away at least partially before moving assembly 42.

Figure 4:
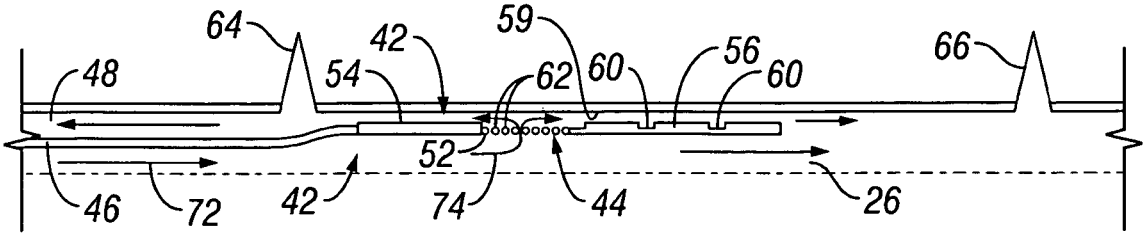
FIG. 4 is schematic illustration of the embodiment illustrated in FIG. 2 showing backwashing of the packer, according to an embodiment of the present invention.

In the embodiment illustrated in FIG. 4, packer 68 is unset, e.g. eliminated, by backwashing through screen 52. Fluid is flowed downwardly through an interior of tubing 46, as indicated by arrow 72, and at least a portion of this liquid is directed radially outward through openings 62 of screen 52, as indicated by arrows 74. The liquid moving radially outward through screen 52 washes away the particulate matter forming packer 68.

Figure 5:
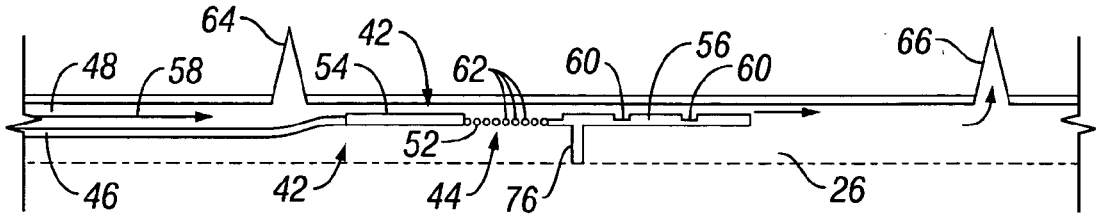
FIG. 5 is a schematic illustration of an alternate embodiment of the system illustrated in FIG. 4.

The backwashing procedure can be enhanced by blocking or restricting downward flow of liquid below the screen 52, as illustrated in FIG. 5. The downward flow is prevented or restricted by a blocking member 76, such as a control valve. However, blocking member 76 may comprise a plug, valve or other suitable device positioned in the interior of assembly 42 between, for example, screen 52 and choke 56. By restricting downward flow below screen 52, more liquid is forced radially outward through screen 52 which enhances elimination of packer 68. In some applications, packer 68 also can be removed by blocking flow through the dehydration device and flushing the packer with a flow of liquid directed downwardly along annulus 48. In still other applications, packer 68 may be eliminated by flushing from a downward location. For example, following a fracturing procedure in an upper zone, the pressure utilized in the fracturing process is released. If a sufficiently high pressure exists in a lower zone, e.g. from a previous fracturing process, flow of fluid automatically moves up through the wellbore and washes the particulate matter of packer 68 uphole. This enables movement of assembly 42 to the next location.

It should be noted that in some applications slurry 58 may comprise a particulate matter that is acid soluble. This technique allows the packer to be eliminated by dissolving the packer with an acid. For example, an acidic liquid can be pumped downhole to the packer 68 to dissolve the packer.

Figure 6:
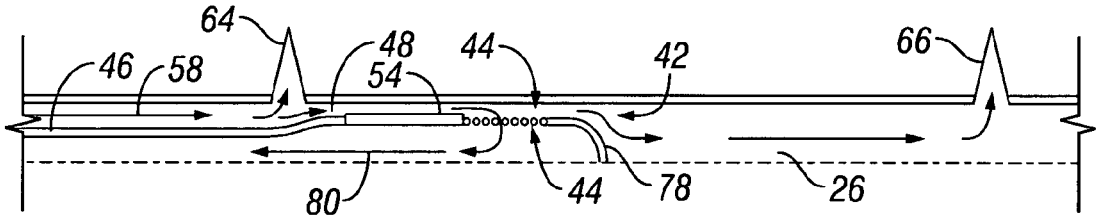
FIG. 6 is a schematic illustration of another embodiment of the system illustrated in FIG. 2.
Figure 7:
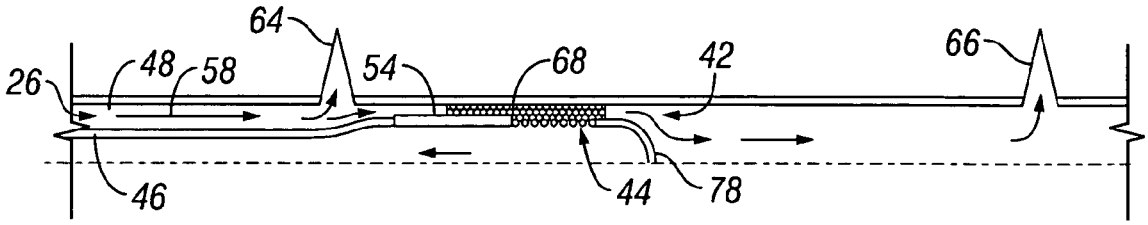
FIG. 7 is a schematic illustration of the embodiment illustrated in FIG. 6 with a packer formed, according to an embodiment of the present invention.

In another embodiment, downward flow of liquid within assembly 42 is prevented by a blocking member 78, as illustrated in FIG. 6. In this example, the second, or return, flow path is created in an upward direction, as indicated by arrow 80. The second flow path 80 extends upwardly through tubing 46 to, for example, wellhead 30 where it can be redirected to a collection location. In a manner similar to that described above, slurry 58 is directed downwardly along annulus 48 to dehydration device 44, which is illustrated for discussion purposes as screen 52. At dehydration device 44, the particulate matter is again deposited, and the separated liquid is directed along second flow path 80. As illustrated by FIG. 7, the particulate matter is deposited along the dehydration device 44 to create packer 68. The packer 68 continues to build and spread over pack seal area 54 until the areas above and below the packer 68 are sufficiently isolated for additional application procedures. It should be noted that the illustrated embodiment does not include a choke because a pressure reduction across the screen is provided due to the ability of the fluid to flow up through tubing 46. A choke can be used or omitted in any of these embodiments, depending on the application as well as the design and size of the well assembly components, as long as a pressure differential is created across the screen to cause dehydration of the slurry.

Figure 8:
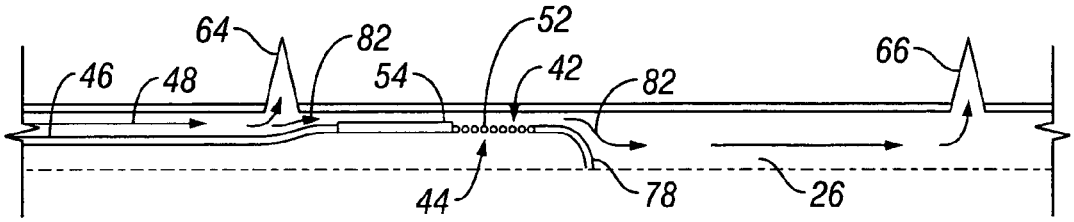
FIG. 8 is a schematic illustration of the embodiment illustrated in FIG. 6 with the packer being flushed, according to an embodiment of the present invention.

When flow 80 continues up through the interior of tubing 46, packer 68 continues to build. However, closing off the upward flow through tubing 46 by, for example, a valve disposed at wellhead 30, additional packer formation is prevented. This lack of flow may be used to clear the packer by, for example, flushing the packer with a downward liquid flow along annulus 48, as illustrated with arrows 82 in FIG. 8. Clearing the packer by flushing the packer with liquid flow along annulus 48 can be achieved if the liquid flow velocity is sufficient to remove particles from the bottom of packer 68. In the alternative, packer 68 maybe cleared by pumping backwashing liquid downwardly through the interior of tubing 46, as discussed above.

Figure 9:
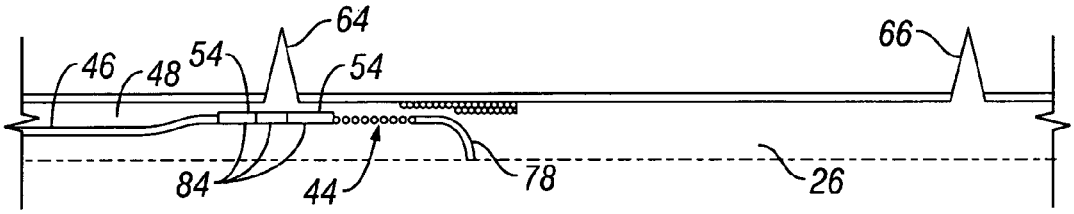
FIG. 9 is a schematic illustration of the assembly illustrated in FIG. 6 during movement within the wellbore, according to an embodiment of the present invention.

Alternatively, packer 68 may be unset, e.g. cleared, simply by pulling on the work string (in this example tubing 46) as illustrated in FIG. 9. This technique can be used if the assembly 42 has not become "stuck" in packer 68. Additionally, assembly 42, e.g. a bottom hole assembly, can be designed with a taper in which the diameter of the assembly decreases in a downward direction to facilitate pulling of the assembly from the packer (see FIG. 9). Additionally, pack seal area 54 can be designed with telescoping joints 84 which are held together axially during the desired wellbore procedures. Upon conclusion of the downhole procedures, the telescoping joints 84 are axially released. Thus, lifting on tubing 46 acts on only one pack seal section 84 at a time and breaks the packer with a lower pull force then otherwise required to break the entire packer seal length.

Figure 10:
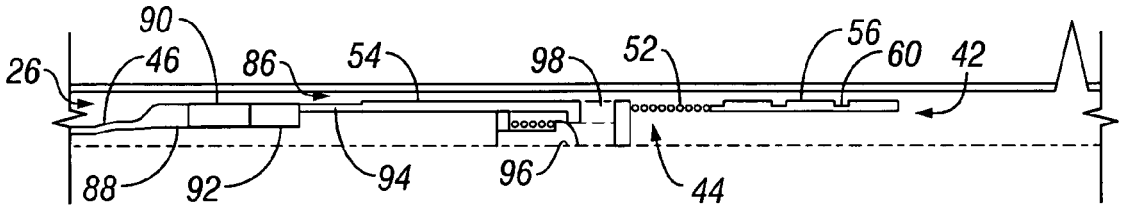
FIG. 10 is a schematic illustration of another embodiment of the system illustrated in FIG. 2.

With further reference to FIG. 10, assembly 42 is illustrated as a complete bottom hole assembly 86. In this embodiment, bottom hole assembly 86 can be used for a variety of wellbore application procedures, including forming perforations, isolating zones, stimulating the formation, breaking the packer and repeating the process at additional locations, e.g. at multiple layers, within the wellbore 26. In this example, bottom hole assembly 86 comprises a connector 88 by which the assembly is coupled to tubing 46. The assembly further comprises a disconnect 90 and a dual circulation valve 92. An abrasive jetting nozzle 94 is positioned proximate pack seal area 54. An internal check valve 96 is positioned within the assembly proximate a reverse circulation port 98. In this embodiment, reverse circulation port 98 is disposed between pack seal area 54 and dehydration device 44 which may be in the form of screen 52. Additionally, choke 56 may be deployed downwardly from dehydration device 44.

Figure 11:
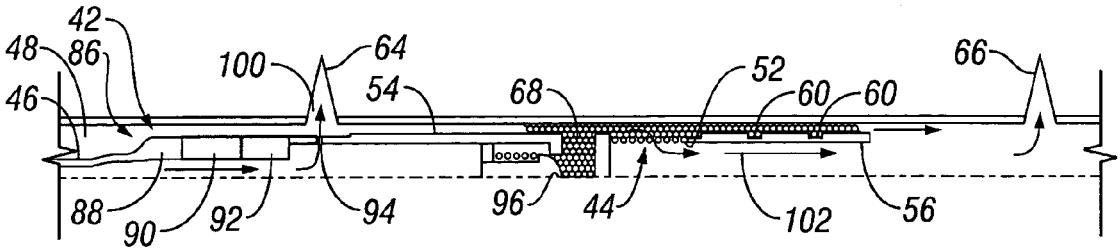
FIG. 11 is another schematic illustration of the embodiment of the system illustrated in FIG. 10.

As illustrated in FIG. 11, perforations, such as perforations 64 can be formed via directing a high-pressure stream of abrasive jetting particles through abrasive jetting nozzle 94, as indicated by arrow 100. In one application example, the jet perforations are formed, and then packer 68 is built. The abrasive jetting particles can be carried in a slurry similar to the packer building slurry. In one embodiment, however, the size of the abrasive jetting particles and screen 52 are selected to enable passage of the abrasive jetting particles through screen 52 while restricting the flow of particulate matter used in the packer building slurry. This enables removal of the abrasive jetting particles. In another embodiment, the size of the abrasive jetting particles and screen 52 are selected such that screen 52 becomes plugged by the abrasive jetting particles during the abrasive jetting process. Upon completion of the abrasive jetting process, screen 52 can be flushed to remove the clogging abrasive jetting particulates, thereby enabling building of packer 68.

According to another methodology, the abrasive jetting technique is replaced with a shaped charge perforating technique. Jetting nozzle 94 is replaced with a perforating gun assembly having shaped charges arranged to create perforations. When the shaped charges are ignited, the resulting directed explosions create perforations.

In any event, the slurry for packer 68 can be directed downwardly along annulus 48 such that the particulate matter is deposited around choke 56 and screen 52. The liquid separated from the particulate matter is directed along a second flow path routed downwardly through the interior of bottom hole assembly 86, as indicated by arrows 102.

Figure 12:
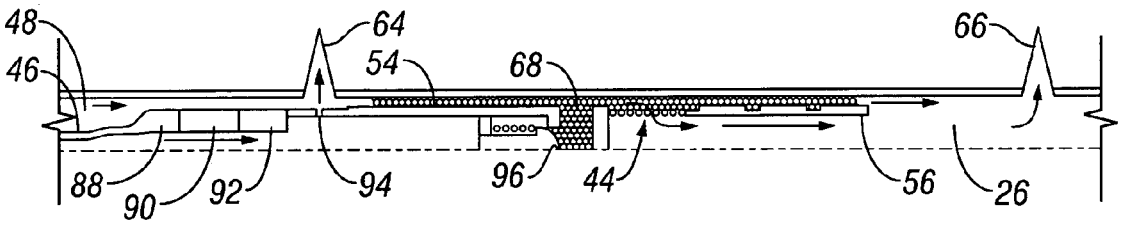
FIG. 12 is another schematic illustration of the embodiment of the system illustrated in FIG. 10.

As the process is continued, packer 68 builds as particulate matter is deposited upwardly along pack seal area 54, as illustrated in FIG. 12. A pressure test may be performed to verify packer 68 was properly built prior to commencing subsequent procedures, such as stimulation of the formation. In this embodiment, a low flow rate of fluid may be maintained downwardly through the tubing 46 to maintain the check valve 96 in a closed position and the jetting nozzle 94 open during creation of the packer.

Figure 13:
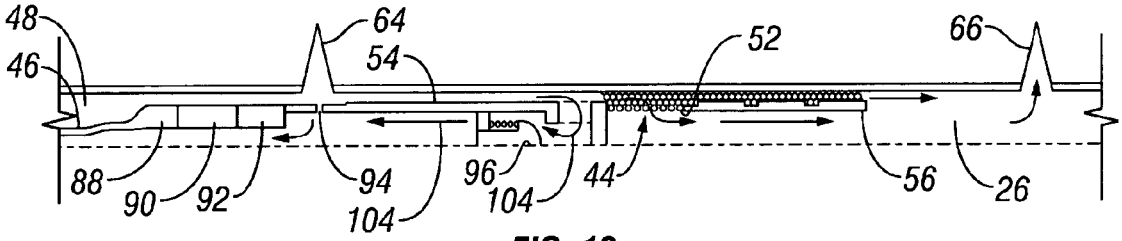
FIG. 13 is another schematic illustration of the embodiment of the system illustrated in FIG. 10.

Upon completion of the wellbore procedure, the interior of tubing 46 is opened for flow at the surface resulting in check valve 96 opening to enable upward flow 104 of flushing fluid through tubing 46, as illustrated in FIG. 13. Accordingly, a flushing fluid can be flowed downhole along annulus 48, inwardly through check valve 96 and upwardly through the interior of tubing 46 to remove packer 68. In this embodiment, the flushing flow is not directed past screen 52 and choke 56 for complete cleaning of that area. Because the pack seal area is the primary cause of mechanical sticking, and it has been flushed, this should enable pulling of the bottom hole assembly 86 from that area of wellbore 26 for movement of the assembly to the next desired area of wellbore 26 where additional procedures can be conducted. For example, when moved to the next desired wellbore area, perforations can be formed, and packer 68 can again be created to enable formation stimulation or other wellbore procedures.

Figure 14:
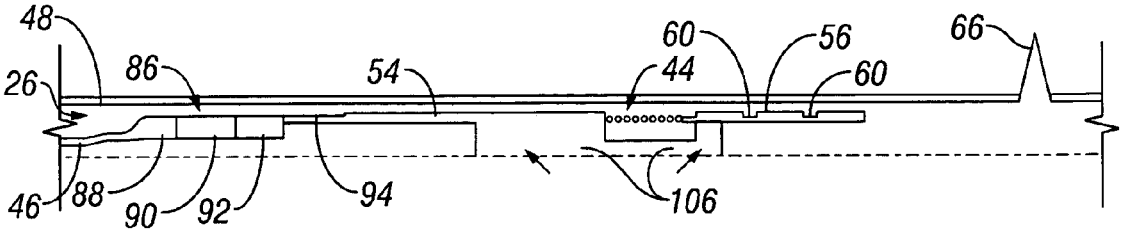
FIG. 14 is a schematic illustration of another embodiment of the system illustrated in FIG. 2.

In another embodiment illustrated in FIG. 14, bottom hole assembly 86 comprises a control valve 106 which can be used to control fluid flow through assembly 86. Thus, control valve 106 can be actuated to control the building of packer 68 and/or to control the flow of fluid during backwashing of screen 52. Control valve 106 also can be used to control a return flow of fluid through tubing 46 and can even incorporate a "dump valve" function. Control valve 106 can be actuated via a variety of mechanisms, including a J-slot mechanism that can be pressure cycled, a mechanically actuated push-pull mechanism, or a mechanism that can be actuated by appropriate input through a control line, such as an electrical, hydraulic or optical control line.

In this latter embodiment, control valve 106 is readily controllable to implement many of the functions described above. For example, control valve 106 can be set for creation of perforations via the abrasive jetting nozzles 94. Upon completion of the perforations, control valve 106 is actuated to permit inward flow through screen 52 for creation of the packer. Following any subsequent operations, control valve 106 can be actuated to permit downward flow of fluid through the interior of tubing 46 for backwashing of screen 52 and the removal of packer 68. As described above, this enables movement of the bottom hole assembly 86 to the next desired location for subsequent wellbore procedures.

It should be noted that wellbore assembly 22 is amenable to creation of packers for use in other applications. For example, a variety of well related procedures, other than those discussed above, can benefit from the simple and repeatable methodology for formation of packers in situ.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of creating a packer in a wellbore, comprising:

deploying a screen downhole via a tubing;

flowing a slurry of liquid and particulate matter from a wellhead downwardly to the screen though an annulus surrounding the tubing, the annulus extending from the wellhead to the screen; and generating a packer by passing the liquid through the screen while substantially blocking movement of the particulate matter through the screen.

2. The method as recited in claim 1, further comprising locating a choke below the screen.

3. The method as recited in claim 1, wherein generating comprises utilizing a cup style packer to encourage passing of the liquid through the screen.

4. The method as recited in claim 1, further comprising backwashing through the screen to clear the packer.

5. The method as recited in claim 1, further comprising directing the liquid that passes through the screen downwardly into the wellbore.

6. The method as recited in claim 1, further comprising directing the liquid that passes through the screen upwardly though an interior of the tubing.

7. The method as recited in claim 1, further comprising removing the screen by pulling on the tubing.

8. The method as recited in claim 1, further comprising removing the packer by backwashing through the screen and pulling on the tubing.

9. The method as recited in claim 1, further comprising forming perforations while generating the packer.

10. The method as recited in claim 1, further comprising forming perforations with an abrasive jetting technique.

11. The method as recited in claim 10, further comprising sizing the screen to pass abrasive jetting particles and to restrict the packer building particulate matter.

12. The method as recited in claim 10, further comprising sizing the screen to plug with abrasive jetting particles during the abrasive jetting process.

13. The method as recited in claim 1, further comprising forming perforations with a shaped charge perforating technique.

14. The method as recited in claim 1, further comprising controlling flow through the screen with a control valve.

15. The method as recited in claim 1, wherein deploying comprises deploying the screen with coiled tubing.

16. The method as recited in claim 1, further comprising sequentially treating the well and eliminating the packer.

17. The method as recited in claim 16, further comprising repeating generation of the packer, treatment of the well and elimination of the packer at another location in the wellbore without removing the screen from the wellbore.

18. The method as recited in claim 16, further comprising forming perforations prior to generating the packer.

19. The method as recited in claim 1, wherein the packer is generated with a particulate selected from the group consisting of an acid soluble particulate, an alkaline soluble particulate, and a particulate soluble in an organic solvent.

20. The method as recited in claim 1, wherein the packer is generated with an alkaline soluble particulate.

21. The method as recited in claim 1, wherein the packer is generated with a particulate soluble in an organic solvent.

22. The method as recited in claim 1, wherein the particulate is comprised of particles that are substantially flaky.

23. The method as recited in claim 1, further comprising utilizing a computer-based system to monitor well conditions during generation of the packer.

24. The method as recited in claim 1, wherein deploying comprises deploying the screen within an outlying screen such that the annulus extends between the screen and the outlying screen.

25. The method as recited in claim 1, further comprising controlling flow through the screen with a control valve.

26. A method of creating a packer in a wellbore, comprising:

supplying a slurry to a dehydration device located downhole, via a direct supply flow path located along an annulus surrounding a tubing, the annulus extending downhole from a wellhead to the dehydration device;

depositing particulate matter on an external side of the dehydration device to generate a packer;

removing liquid along a single removal flow path;

conducting a well related procedure;

moving the dehydration device to another wellbore location without removing the dehydration device from the wellbore; and repeating the process of generating a packer and conducting a well related procedure.

27. The method as recited in claim 26, wherein supplying comprises supplying the slurry to the dehydration device formed as a screen.

28. The method as recited in claim 26, further comprising routing the removal flow path through an interior of the tubing.

29. The method as recited in claim 26, further comprising routing the removal flow path to a location further downhole.

30. The method as recited in claim 27, further comprising removing the packer by backwashing a liquid through the screen.

31. The method as recited in claim 26, wherein conducting comprises conducting a well treatment procedure.

32. The method as recited in claim 26, further comprising forming perforations prior to each generation of the packer.

33. A method of creating a packer in a wellbore, comprising:

deploying a wellbore assembly in the wellbore, the wellbore extending from an upper surface;

flowing a slurry from the upper surface through an annulus surrounding the wellbore assembly to a desired location in the wellbore, the annulus extending from the upper surface to the desired location; and dehydrating the slurry at the desired location.

34. The method as recited in claim 33, wherein dehydrating comprises creating a pressure drop.

35. The method as recited in claim 34, wherein dehydrating comprises creating the pressure drop across a plurality of annular orifices.

36. The method as recited in claim 34, wherein dehydrating comprises creating the pressure drop across a restriction to flow along the annulus proximate the desired location.

37. The method as recited in claim 33, wherein dehydrating comprises creating a packer to isolate an openhole zone.

38. The method as recited in claim 33, wherein dehydrating comprises dehydrating the slurry at a plurality of desired locations disposed at a plurality of layers to sequentially generate a plurality of packers.

39. The method as recited in claim 38, further comprising forming perforations along a wellbore wall prior to generating each packer of the plurality of packers.

40. A system for creating a packer in a wellbore, comprising:

a wellbore assembly deployed in the wellbore, the wellbore assembly creating an annulus along its exterior, the annulus serving as a first flow path from a surface location to a downhole location and extending from a wellhead to the downhole location, the wellbore assembly also defining a second flow path along its interior, wherein the wellbore assembly comprises a dehydration device positioned to create a packer when a slurry of particular matter and liquid is directed along the first flow path such tat the liquid moves through the dehydration device to the second flow path while the particulate matter is deposited to form the packer.

41. The system as recited in claim 40, wherein the wellbore assembly comprises tubing to support the dehydration device.

42. The system as recited in claim 40, wherein the wellbore assembly comprises a perforation device.

43. The system as recited in claim 40, wherein the second flow path directs the liquid further downhole.

44. The system as recited in claim 41, wherein the second flow path directs the liquid upwardly through an interior of the tubing.

45. The system as recited in claim 40, wherein the wellbore assembly comprises a choke.

46. The system as recited in claim 40, wherein the dehydration device comprises a screen.

47. The system as recited in claim 40, wherein the dehydration device comprises a screen, and the wellbore assembly comprises a control valve to control the flow of liquid through the screen.

48. The system as recited in claim 40, wherein the wellbore assembly comprises a telescoping joint to facilitate removal of the dehydration device from the packer.

* * * * *